United States Patent [19]

Kawamura et al.

[11] Patent Number: 4,465,160

[45] Date of Patent: Aug. 14, 1984

[54] HORN SPEAKER

[75] Inventors: Akihisa Kawamura, Moriguchi; Noboru Mikami, Osaka; Atsushi Yukiyoshi, Neyagawa, all of Japan

[73] Assignee: Matsushita Electric Industrial Co., Ltd., Osaka, Japan

[21] Appl. No.: 315,454

[22] Filed: Oct. 27, 1981

[30] Foreign Application Priority Data

Oct. 30, 1980 [JP] Japan ..... 55-153504

[51] Int. Cl.[3] ..... G10K 11/00

[52] U.S. Cl. ..... 181/192

[58] Field of Search ..... 181/152, 159, 187, 192, 181/195, 173

[56] References Cited

U.S. PATENT DOCUMENTS 3,292,727 12/1966 Bschorr ..... 181/185 X 4,308,932 1/1982 Keele, Jr. ..... 181/192 X

*Primary Examiner*—L. T. Hix

*Assistant Examiner*—Brian W. Brown

*Attorney, Agent, or Firm*—Stevens, Davis, Miller & Mosher

[57] ABSTRACT

A horn speaker capable of forming a uniform sound field of a high fidelity and uniform tone quality and clearness, regardless of the position of listeners, suitable for use in broadcastings in a hall, station yard, playground and so forth. The horn speaker has a horn defined by four wall surface each of which is given by the equation of:

$$a=a_o(l+\alpha x)^n$$

where, $a_o$ represents the size of the throat, a represents the size of cross-section at a distance x from the throat and $\alpha$ represents the divergence coefficient. The n takes a value $n_1$ ($n_1 \geqq 2$) at the open end side of the horn and a different value $n_2$ ($n_2 \geqq n_1$) at the throat side. In addition, the tangential angle at the open end of the horn is selected to fall between $1.5\theta$ and $2.0\theta$, where $\theta$ represents a half of the directivity angle which is an angle causing a 6 dB drop of the sound pressure from the sound pressure on the axis of the polar directivity characteristics.

6 Claims, 21 Drawing Figures

HORN SPEAKER

BACKGROUND OF THE INVENTION

The present invention relates to a horn speaker suitable for use in indoor or outdoor broadcastings such as a broadcasting in a hall, a station yard, a playground or the like, the capable of forming a uniform sound field for a number of listeners to permit the listeners to listen to the sound at the same tone quality and clearness and at a high fidelity of reproduction, regardless of the positions occupied by the listeners. More particularly, the invention is concerned with a horn speaker which is improved to suppress the disturbance of radiation impedance and to flatten the frequency characteristics.

Conventional horns incorporate various types of horns such as a radial horn, a conical horn and so forth. The radial horn is designed to generate arcuate wave surfaces in a horizontal plane so that arcuate wave surfaces are propagated in a concentric manner along the inner surface of the horn. This type of horn, therefore, transmits sound in the form of concentric wave surfaces to exhibit a superior directivity in the horizontal direction. However, the directivity in the vertical direction is not so good in this type of horn.

On the other hand, the conical horn disadvantageously suffers a problem of disturbance in the radial impedance characteristics, although it exhibits high directivities in both of horizontal and vertical directions.

FIGS. 1*a* and 1*b* show a conical horn which is disclosed in Japanese Patent Laid-open No. 12724/1979. This conical horn is formed of two conical horns in combination and, has lateral wall curves made straight. This conical horn, however, exhibits a large disturbance of radiation impedance.

FIG. 2*a* shows the shape of side wall of an exponential conical Bessel horn which is a typical conventional horn, while FIG. 2*b* shows the radial impedance characteristics of this horn. The shape of this horn is given by the following Webster's general equation concerning the Bessel horn.

$$S_M = S_o(1+\alpha x)^n$$

where, $S_M$: cross-sectional area of the horn $S_o$: cross-sectional area of throat $\alpha$: divergence coefficient x: distance from throat In the above-mentioned equation, the case where n equals to 1 corresponds to the conical horn, the case where n is infinitive ($\infty$) corresponds to the exponential horn and the case where n takes a value intermediate between 1 and infinitive corresponds to the Bessel horn.

As will be understood from FIG. 2*b*, the disturbance of the radiation impedance becomes greater as the value of n gets smaller and, hence, the conical horn exhibits the greatest disturbance of the radiation impedance.

SUMMARY OF THE INVENTION

Accordingly, an object of the invention is to overcome the above-described problems of the prior art.

To this end, according to the invention, there is provided a horn speaker characterized by comprising a horn defined by four wall surfaces, the portion of each wall surface between the opening end and the throat satisfying the equation of:

$$a = a_o(1+\alpha x)^n$$

where, $a_o$ represents the size of the throat, a represents the size of cross-section at a distance x from the throat and $\alpha$ represents a divergence coefficient, the value of n being a coupling form of a function which takes a value $n_1(n_1 \geqq 2)$ at the open end of the horn and a value $n_2(n_2 > n_1)$ at the throat, the horn further satisfying the condition that the angle of tangential line at the open end of the horn falls between 1.50 and 2.00, where 0 represents a half of the directivity angle which is the angle causing a 6 dB reduction of sound pressure from the sound pressure on the axis of polar directivity characteristics.

The above and other objects, as well as advantageous features of the invention will become clear from the following description of the preferred embodiments taken in conjunction with the accompanying drawings.

DESCRIPTION OF THE PREFERRED EMBODIMENTS

Figure 1A:
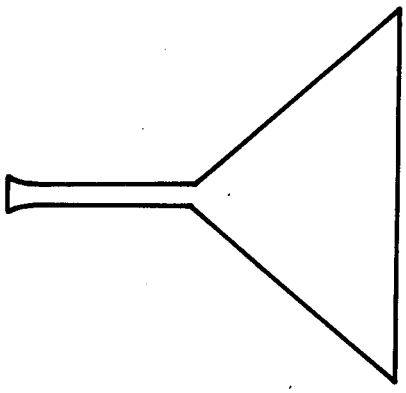
FIG. 1a PRIOR ART
FIGS. 1*a* and 1*b* are a horizontal sectional view and a vertical sectional view of a conventional horn speaker.
Figure 1B:
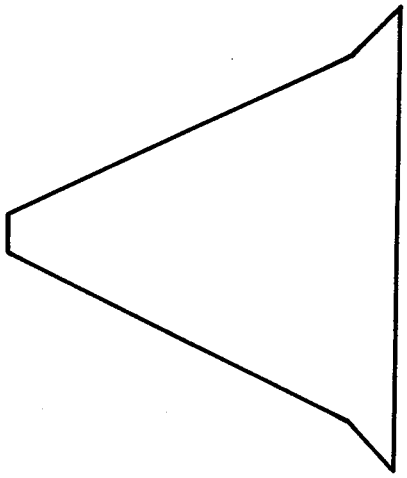
FIG. 1b PRIOR ART
Figure 2A:
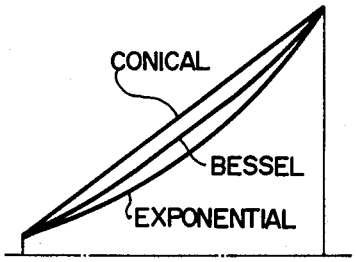
FIG. 2*a* shows sections of half parts of various types of conventional horns.
Figure 2B:
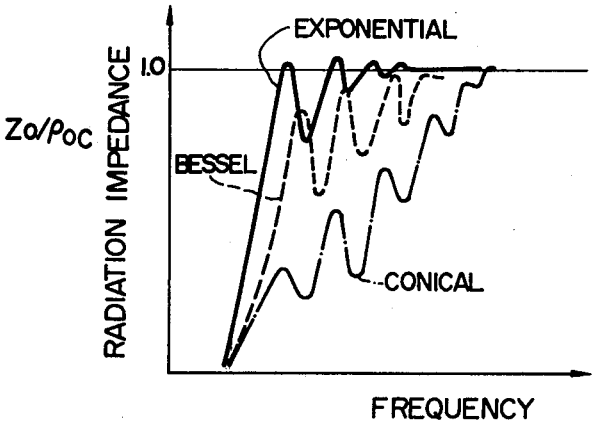
FIG. 2*b* shows radiation impedance characteristics of the horns shown in FIG. 2*a;*
Figure 3:
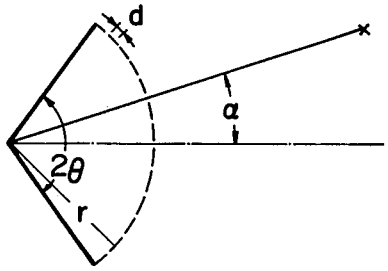
FIG. 3 illustrates a model of an arcuate sound source.

In order to achieve the present invention, the present inventors have made a simulation of the directivity of an angular horn having straight side walls, by means of Wolb & Malter's equation using a model of arcuate line sound source which operates at an equal sound pressure and equal phase at the open end of the horn as shown in FIG. 3. Wolb & Malter's equation:

$$R_\alpha = \frac{1}{2m+1} \sum_{k=-m}^{m} \cos\left(\frac{2\pi\Gamma}{\lambda}\cos(\alpha + k\theta)\right. \frac{\sin\left\{\frac{\pi d}{\lambda}\sin(\alpha + k\theta)\right\}}{\frac{\pi d}{\lambda}\sin(\alpha + k\theta)} +$$

$$j \sum_{k=-m}^{m} \sin\left\{\frac{2\pi\Gamma}{\lambda}\cos(\alpha + k\theta)\right\} \frac{\sin\left\{\frac{\pi d}{\lambda}\sin(\alpha + k\theta)\right\}}{\frac{\pi d}{\lambda}\sin(\alpha + k\theta)}$$

where $R_\alpha$ represents the directivity coefficient of the angle $\alpha$, r represents the radius of curvature, d represents the length of the segment of the line sound source divided into (2m+1) segments, and k is a constant given $k=2\pi f/c$.

Figure 4:
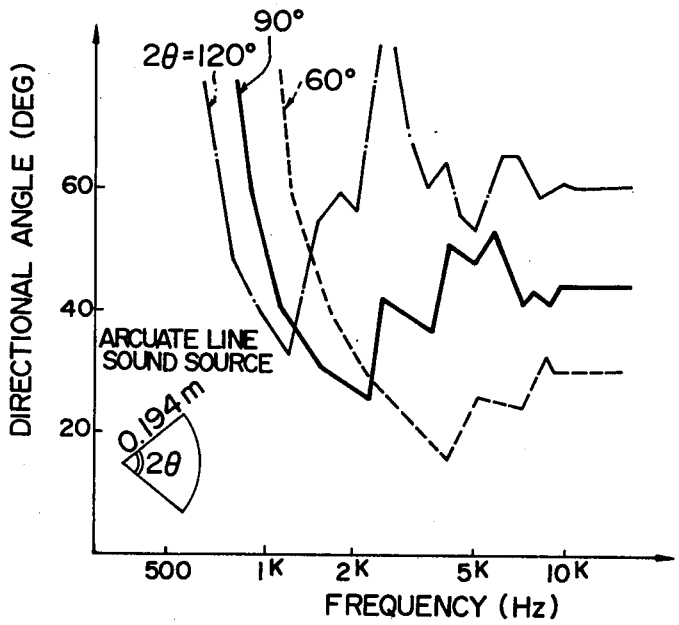
FIGS. 4 and 5 show the directivity angle characteristics of the arcuate sound source model as shown in FIG. 3.
Figure 5:
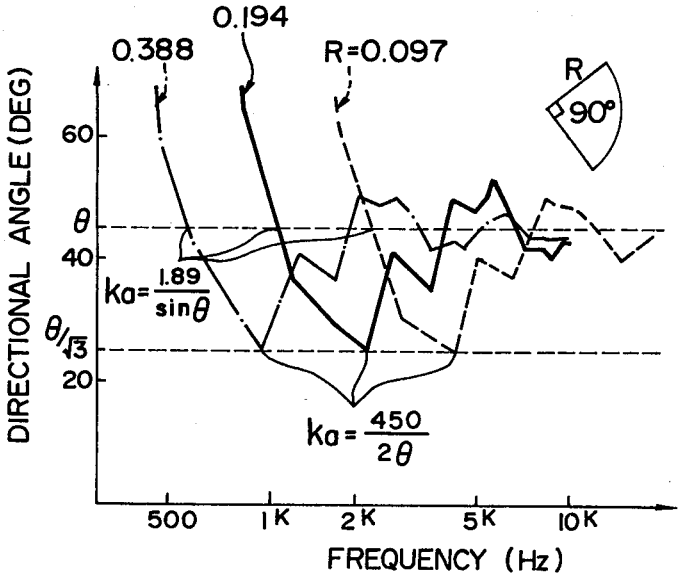
Figure 6A:
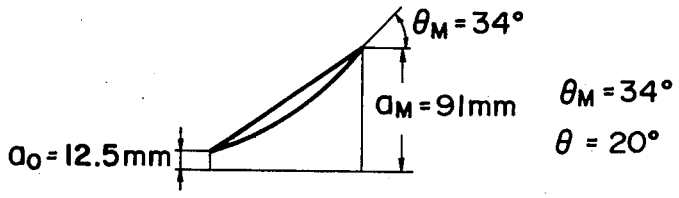
FIGS. 6*a* and 6*b* show sections of various forms of horn and directivity angle characteristics of these horns.
Figure 6B:
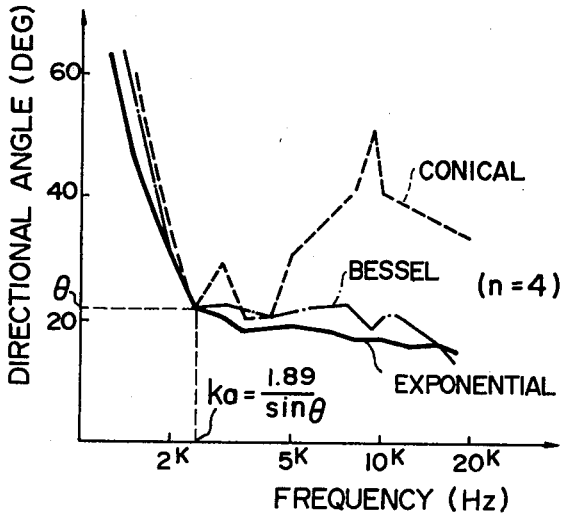

Calculations were made in accordance with the above equations while varying the tangential angle at the open end of the horn and the radius of curvature r, the results of which are shown in FIGS. 4 and 5. It will be seen that, at the low frequency region, the angle of opening of the horn and the directivity angle coincide with each other at the frequency given by $ka=1.89/\sin\theta$It will be seen also that the directivity angle approaches the opening angle in the high frequency region. The directivity angle at the low region centered at $ka \div 450/2\theta$ is selected to be about $\theta/\sqrt{3}$ in order to make the directivity angle uniform. The present inventors have made a hypothesis that the tangential angle at the horn opening, which is the factor controlling the directivity in this region, is about $\sqrt{3}\,\theta$, and produced a horn in accordance with this hypothesis. The characteristics as measured with this horn are shown in FIG. 6*b*. As will be seen from FIG. 6*b*, in the Bessel horn, the directivity angle is $\theta$ in the low region provided that the tangential angle at the horn opening is selected to be about $\sqrt{3}\,\theta$. This means that the above-mentioned hypothesis is correct.

Figure 6C:
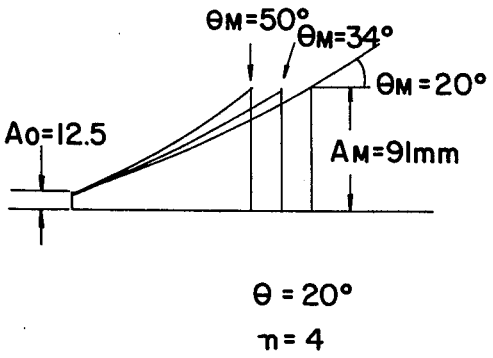
FIGS. 6*c* and 6*d* show directivity angle characteristics when the tangential angle at the horn opening varies from 1.50 to 2.00.
Figure 6D:
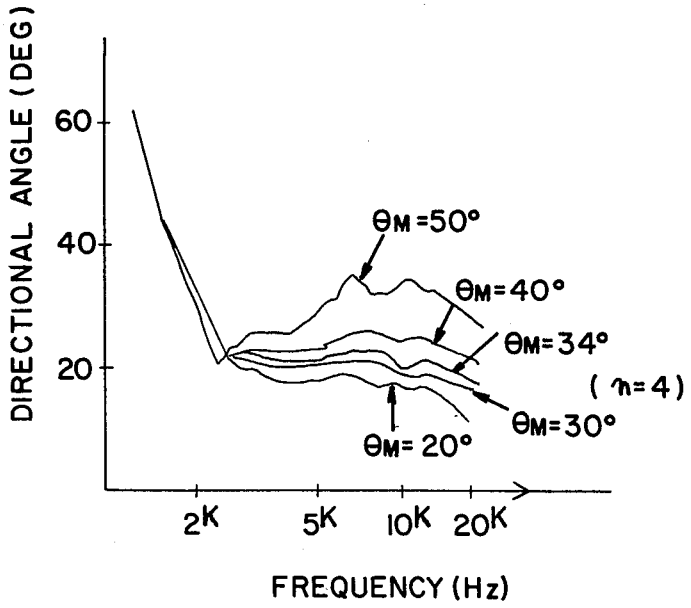

FIGS. 6*c* and 6*d* show directivity angle characteristics when the tangential angle at the horn opening varies from $1.5\theta$ to $2.0\theta$; FIG. 6*d* also shows that the horn having a tangential angle at is opening from $1.5\theta$ to $2.0\theta$ give a substantial desired directivity angle, since the directive angles of the horns having tangential angles between $1.5\theta$ to $2.0\theta$ fall within a range between $\pm$ 0.5 degrees of a desired directivity angle.

The present inventors have produced horns having tangential angle of $1.5\theta$ to $2.0\theta$ at the horn opening, and measured the characteristics to find the fact that the directivity angle of $\theta$ is obtained also in this case and that the best result is obtained when the tangential angle is $\sqrt{3}\,\theta$.

Figure 7A:
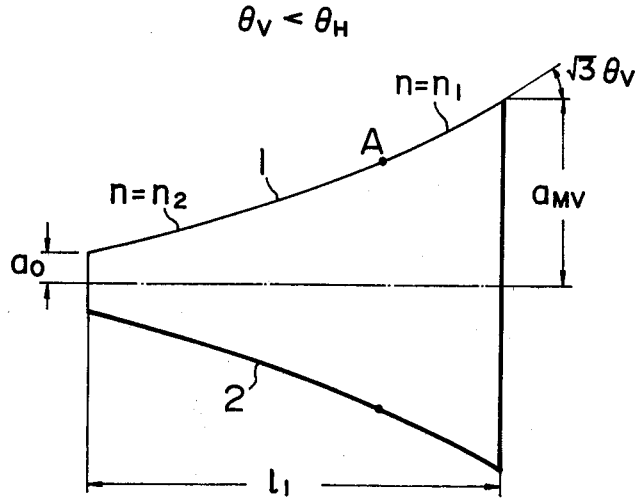
FIGS. 7*a* and 7*b* are a vertical sectional view and a horizontal sectional view of a horn speaker constructed in accordance with an embodiment of the invention.
Figure 7B:
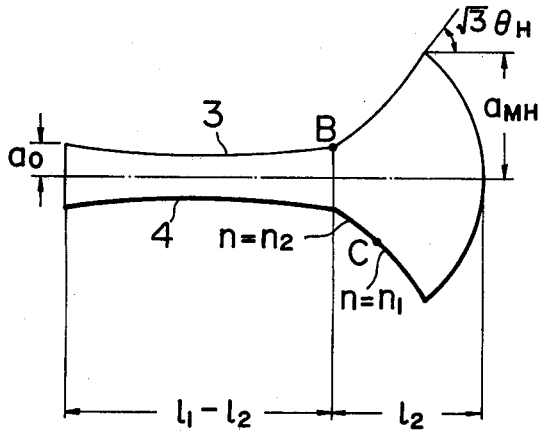

FIGS. 7*a* and 7*b* show the shapes of horn constructed in accordance with an embodiment of the invention. More specifically, FIGS. 7*a* and 7*b* show a vertical section and a horizontal section, respectively.

The horn of this embodiment consists of four walls 1, 2, 3 and 4. In the case where the directivity angles in the horizontal and vertical directions are equal, the connection angle of the side wall at the horn opening is selected to be about $\sqrt{3}\,\theta$.

The curve of each side wall is given by the following function.

$$a=a_o(1+\alpha x)^n$$

where, $a_o$ represents the size (the widthwise length of the side wall measured from the symmetrical line thereof) of throat, a represents the size of the cross-section at a distance x from the throat and $\alpha$ represents the divergence coefficient which takes different values at the position of $n_1$ and the position of $n_2$. The n takes a value $n_1(n_1 \geqq 2)$ at the open end of the horn and $n_2(n_2 > n_1)$ at the throat. The point A is determined by the flatness of deviation of the directivity characteristics.

On the other hand, in the case where the directivity angle $\theta_H$ in a horizontal direction and the directivity angle $\theta_v$ in a vertical direction are different, the length becomes smaller as the directivity angle gets greater. Assuming that the directivity angle $\theta_H$ in the horizontal direction is greater than the directivity angle $\theta_v$ in the vertical direction, the curve between the throat to the point B in the $\theta_H$ direction is determined to provide an exponential change in the cross-sectional shape. The curve of the side wall is changed from $n_1$ to $n_2$ at the point C also in this direction. The point C is determined in accordance with the flatness of deviation of the directivity angle characteristics.

Figure 8A:
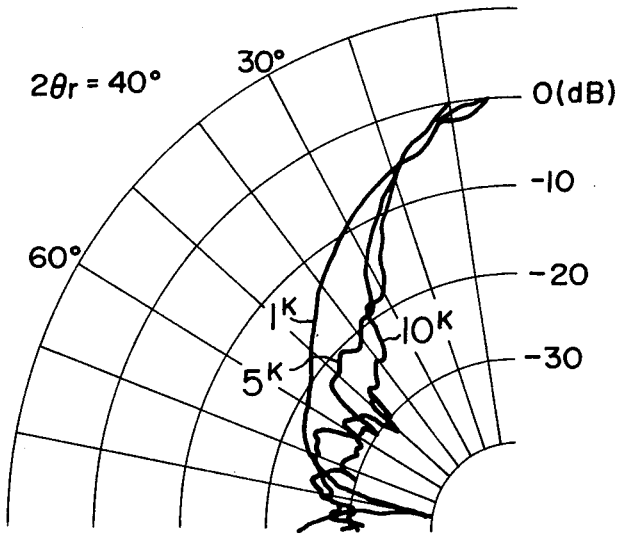
FIGS. 8*a* and 8*b* show directivity characteristic charts of the horn speaker as shown in FIGS. 7*a* and 7*b;*
Figure 8B:
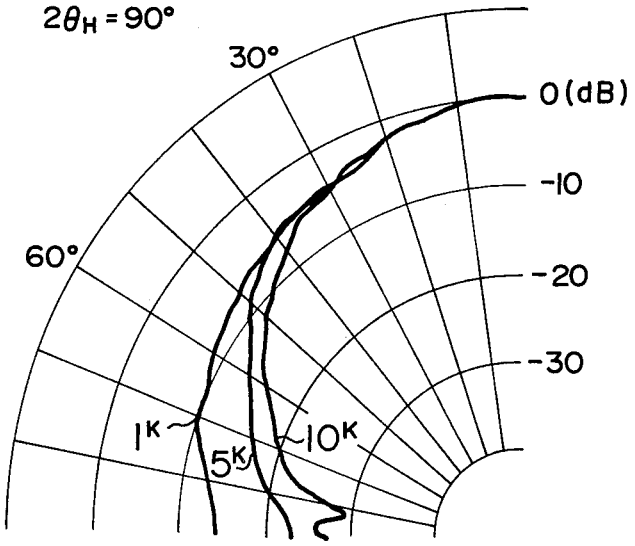
Figure 9A:
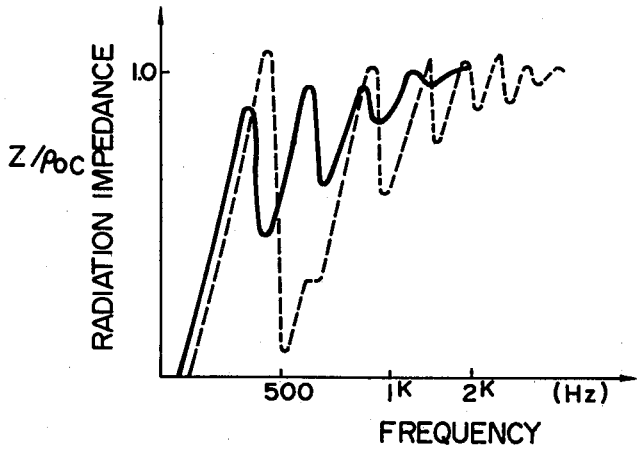
FIGS. 9*a* and 9*b* are charts showing the radiation impedance characteristics and the sound pressure-frequency characteristics of the horn speaker shown in FIGS. 7*a* and 7*b;*
Figure 9B:
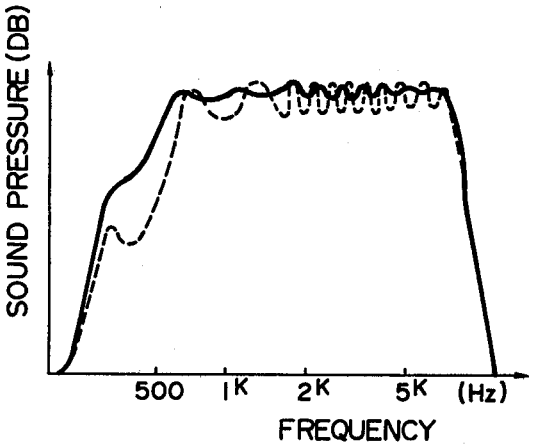

FIGS. 8*a* and 8*b* show the directivity characteristics of the horn speaker in accordance with the invention, while FIGS. 9*a* and 9*b* show the radiation impedance-frequency characteristics of this horn speaker, in comparison with those of a conventional conical horn speaker. Namely, in FIGS. 9*a* and 9*b*, the full-line curves show the characteristics of the horn speaker in accordance with the invention, while the broken-line curves show the characteristics of the conventional conical horn.

In this embodiment, the directivity angles are selected to satisfy the conditions of $2\theta_v=40°$ and $2\theta_H=90°$. It will be seen that the region within these directivity angles, the sound pressure distribution is not largely changed by the frequency nor by the position of the listener. It is also understood that a uniform tone quality is obtained regardless of the position of the listener. It is also known that the frequency characteristics are generally flat thanks to the reduced disturbance of the radiation impedance.

In the embodiment described heretofore, the distance between the throat and the open end along the longitudinal axis is determined to be $l_1$, and the cross-sectional area is changed exponentially to the point at a distance $l_2$ from the open end of the horn. This, however, is not essential.

Figure 10A:
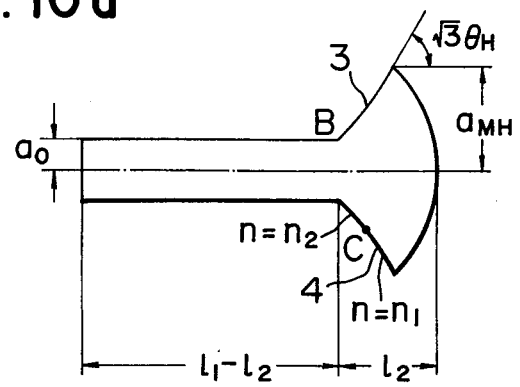
FIGS. 10*a* to 10*d* are horizontal sectional views of horn speakers in accordance with different embodiment of the invention.

Namely, as shown in FIG. 10*a* showing another embodiment of the invention, the cross-sectional area may be changed straight or linearly from the throat to the point on the horn axis spaced $l_2$ from the open end of the horn. In this case, since the opposing walls are parallel with each other, it is easy to form the horn as an integral body so that the production of the horn is facilitated.

Figure 10B:
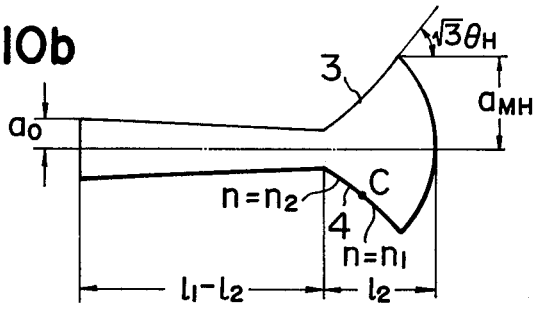
Figure 11:
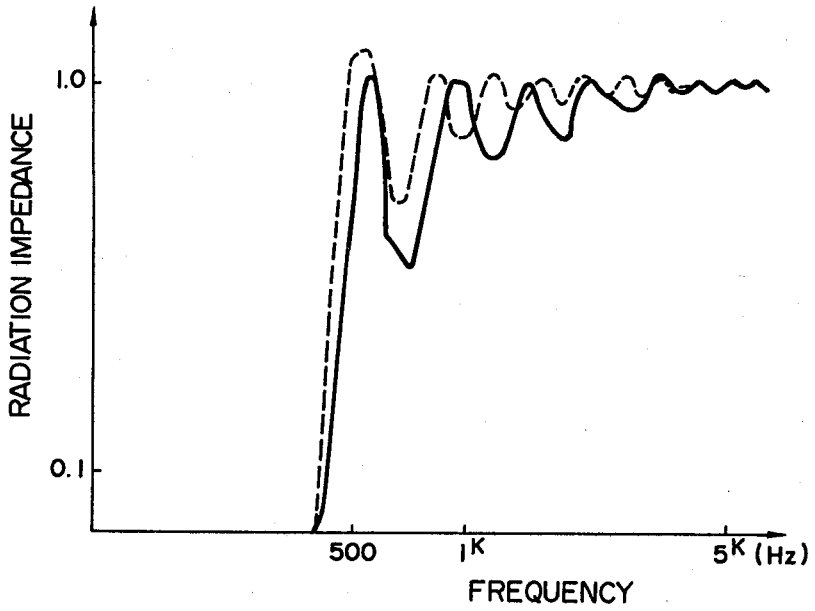
FIGS. 11 and 12 shown the characteristics of the horn speakers shown in FIGS. 10*a* and 10*b*.

FIG. 10*b* shows still another embodiment in which the cross-sectional area of the horn is gradually decreased by a tapered form of the walls from the throat to the point at the distance $l_2$ from the open end of the horn along the horn axis. In this embodiment, since the cross-sectional area is gradually decreased from the throat toward the open end, it is possible to extend the directivity controllable region to the high region as shown by broken-line curve in FIG. 11.

Figure 10C:
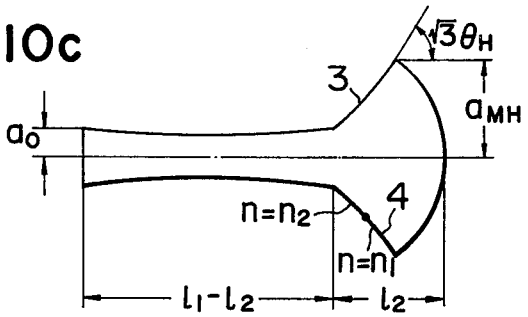
Figure 12:
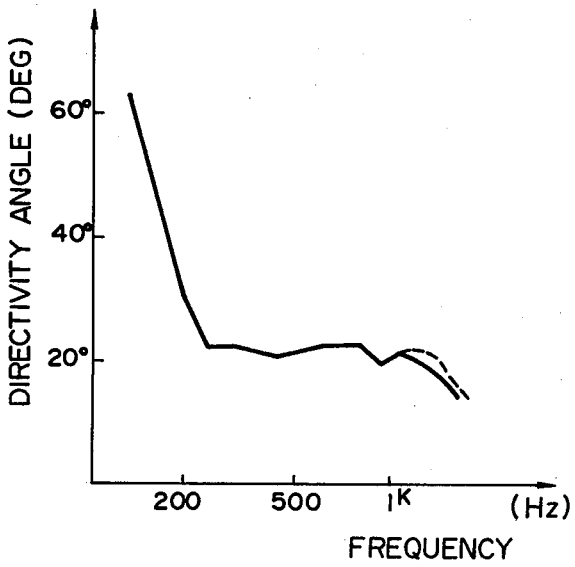

FIG. 10*c* shows a further embodiment in which the cross-sectional area of the horn is changed in a hyperbolic curve from the throat to the point at the distance $l_2$ from the open end along the horn axis. In this case, since the load characteristics are improved in the low region as compared with the case where the cross-sectional area is changed exponentially, the frequency characteristics are flattened as shown by broken lines in FIG. 12 to achieve better sound pressure-frequency characteristics.

Figure 10D:
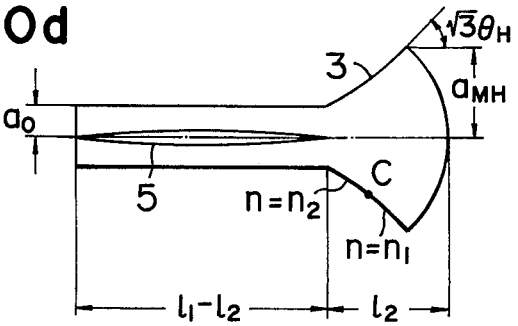

FIG. 10*d* show a still further embodiment in which the cross-sectional area is changed in a rectilinear form from the throat to the point spaced $l_2$ from the open end of the horn along the horn axis. Within the region of the rectilinear change of the cross-sectional area, a partition wall 5 is disposed in parallel to the wall surfaces of the horn in such a manner as to provide an exponential change of the cross-sectional area in this region. The partition wall 5 is connected to the upper and lower walls 1, 2 of the horn. In this case, the production of the horn is facilitated owing to the straight shape of the horn walls.

Thus, by designing the horn to have a change of the cross-sectional area at the throat side different from the curvature of walls at the open side of the horn, it is possible to obtain a small disturbance of the radiation impedance of the horn provided that the cross-sectional area is changed exponentially or hyperbolically. In these cases, the speaker can be loaded at an early timing in the region near the cut-off frequency to achieve a higher flatness of the sound pressure-frequency characteristics. In addition, since the directivity is controlled, the sound pressure is not changed largely by the frequency to permit a uniform tone quality regardless of the position of the listeners.

As has been described, according to the invention, it is possible to obtain a horn speaker which can suppress the large change of sound pressure distribution by frequency and ensure uniform tone quality regardless of the position of listeners, while affording flat frequency characteristics due to the reduced disturbance of the radiation impedance characteristics.

What is claimed is:

1. A horn speaker comprising a horn defined by four wall surfaces, each wall surface between an opening end of the horn and a throat satisfying the condition of:

$$a=a_o(1+\alpha x)^n$$

where, $a_o$ represents the size of said throat, a represents the size of cross-section at a distance x from said throat and $\alpha$ represents a divergence coefficient, n being a value taking $n_1(n_1 \geqq 2)$ at the open end of the horn and $n_2(n_2 > n_1)$ at the throat side of the horn; said horn further satisfying a condition that the angle of tangential line at the open end of said horn falls between $1.5\theta$ and $2.0\theta$, where $\theta$ represents a half of the directivity angle which is the angle causing a 6 dB drop of the sound pressure from the sound pressure on the axis of the polar directivity characteristics, and wherein a directivity angle $\theta_H$ in the horizontal direction and a directivity angle $\theta_V$ in the vertical direction are not equal to each other, and the surfaces of the walls of a greater tangential angle at the horn opening are formed to have a different curvature at the portion thereof between said throat and a point spaced along the horn axis by a distance $l_2$ from the horn opening from a curvature at the portion thereof between said point and said open end of said horn.

2. A horn speaker as claimed in claim 1, wherein the cross-sectional area of said horn is changed exponentially along the horn axis in the region between said throat and said point spaced by said distance $l_2$ from the open end of said horn.

3. A horn speaker as claimed in claim 2, wherein the cross-sectional area of said horn is changed hyperbolically along the horn axis in the region between said throat and said point spaced by said distance $l_2$ from the open end of said horn.

4. A horn speaker as claimed in claim 2, wherein said wall surfaces defining said horn are tapered to gradually decrease the cross-sectional area of said horn along the horn axis in the region between said throat and said point spaced by said distance $l_2$ from the open end of said horn.

5. A horn speaker as claimed in claim 2, wherein the cross-sectional area of said horn is changed in a rectilinear form from said throat toward said open end of said horn in the region between said throat and said point spaced by said distance $l_2$ from said open end of said horn.

6. A horn speaker as claimed in claim 2, wherein the cross-sectional area of said horn is changed in a rectilinear form from said throat toward said open end of said horn in the region between said throat and said point spaced by said distance $l_2$ from said open end of said horn, and wherein a partition wall is arranged in parallel with the wall surfaces to provide an exponential change of cross-sectional area in said region, said partition wall being connected to a pair of opposing walls.

* * * * *